US005489893A

United States Patent [19]

Jo et al.

[11] Patent Number: 5,489,893

[45] Date of Patent: Feb. 6, 1996

[54] MEMORY-TYPE RECORDING/PLAYBACK DEVICE USED BY FITTING A MILK BOTTLE

[76] Inventors: Young Sun Jo, 703-1204 Jugong Apt., Haan-dong, Kwangmyung-Si, Kyungki-Do; Myung Won Ahn, 261-20, Sangdo-dong, Dongjak-Ku, Seoul; Sang Ki Lee, 2-1505, Samsung Apt., Jisan-dong, Dong-Ku, Kwangju-Si, all of Rep. of Korea

[21] Appl. No.: 185,954

[22] PCT Filed: Jan. 13, 1994

[86] PCT No.: PCT/KR94/00004

§ 371 Date: Jan. 18, 1994

§ 102(e) Date: Jan. 18, 1994

[87] PCT Pub. No.: WO94/15573

PCT Pub. Date: Jul. 21, 1994

[30] Foreign Application Priority Data

Jan. 14, 1993 [KR] Rep. of Korea ..... 93-470
Dec. 18, 1993 [KR] Rep. of Korea ..... 93-28412

[51] Int. Cl.[6] ..... G08B 21/00

[52] U.S. Cl. ..... 340/686; 340/687; 340/692; 340/693; 215/11.1; 446/302

[58] Field of Search ..... 340/686, 573, 340/540, 692, 693, 568, 687; 446/267, 302; 215/11.1, 11.6

[56] References Cited

U.S. PATENT DOCUMENTS

| | | | |
|---|---|---|---|
| 4,521,205 | 6/1985 | Spector | 446/302 |
| 4,912,457 | 3/1990 | Ladd | 340/573 |
| 5,307,051 | 4/1994 | Sedlmayr | 340/692 |
| 5,344,034 | 9/1994 | Eagan | 215/11.1 |

*Primary Examiner*—John K. Peng
*Assistant Examiner*—Benjamin C. Lee
*Attorney, Agent, or Firm*—Woodcock Washburn Kurtz Mackiewicz & Norris

[57] ABSTRACT

The present invention provides a recording/playback circuit able to record voice or sound. The device is installed in the inside of a cylindrical case in which a speaker and a recording microphone are installed on the lower surface thereof. A press button-type switch is installed on an upper surface of the case and used as a playback button when a bottle is fitted in the inside of the cylindrical case and the press button type playback button turns on. Audio signals stored in a memory element are played back and necessary information is recorded by a recording button installed at the lower section. In particular, the cylindrical case is formed so as to accommodate the lower part of the bottle in use.

8 Claims, 2 Drawing Sheets

MEMORY-TYPE RECORDING/PLAYBACK DEVICE USED BY FITTING A MILK BOTTLE

FIELD OF THE INVENTION

The present invention relates to a memory-type recording/playback device formed so as to let a baby hear recorded sound by playing it back repeatedly when the lower part of a milk bottle is fitted in the upper case thereof.

To be more particular, the present invention relates to a memory type recording/playback device which commences playback operation when put to the lower part of a milk bottle to let a baby hear mother's voice or music by previously recording it in a memory and playing it back repeatedly.

BACKGROUND OF THE INVENTION

Any parent, if experienced in feeding a baby, wishes to let a baby hear an affectionate story in a sweet voice or wishes to sing a lullaby when the baby drinks from a bottle. Under the conditions of actual life, however, the parents feel that it is a very difficult thing to do so.

Accordingly, when a parent is concerned about household affairs or other things, there are some cases where the baby drinks from a bottle by itself.

Baby care is a hard task for husband and wife both contributing to the family income. There are many instances where a baby is left to the care of others when husbands and wives go to work. Consequently, the baby is kept separated from the parents for so many hours that a problem may arise in the educational and emotional development of the baby.

In other words, a baby who should be kept at parental elbow in the initial stage of his life is separated from the parents for so many hours almost every day that an unfavorable influence is exerted upon the baby. It forms a cause of juvenile problems arising in advanced western countries, as indicated in many studies.

Since the baby is unable to receive a proper education in the stage where learning ability is excellent, negative effect is produced on the development of potentiality.

The products heretofore developed to solve such a problem include a device manufactured to let a baby hear several simple melodies or a sounder used to let the baby hear music. Since it is certain that mother's affectionate voice is most important for baby who is unable to establish a distinction between things, it is particularly important that mother's voice is recorded to let her baby hear it.

In order to solve those problems mentioned above and to be a small help to the healthy growth of a baby, the present inventors came to think of contriving a device like the present invention. Since a baby is almost unable to distinguish between things with its eyes until the age of two but its sense of hearing is developed the present invention is devised to enable the baby to develop potentiality by giving an education through mother's affectionate voice while the baby drinks from a bottle.

OBJECTIVES OF THE INVENTION

An object of the invention is to provide a memory-type recording/playback device which lets a baby hear recorded sound repeatedly through a built-in microphone when a bottle is fitted therein.

Another object of the invention is to provide a memory-type recording/playback device which enables a baby to feel comfortable and repeat learning conducive to intellectual development by letting the baby hear mother's voice in a repeated way when a bottle is fitted therein.

SUMMARY OF THE INVENTION

The present invention is characterized in that a recording/playback circuit able to record voice or sound is installed in the inside of a cylindrical case, a speaker and a recording microphone are installed on the lower surface thereof, and a press button-type switch used as a playback button is installed at the other end and, when a milk bottle is fitted in the inside of the cylindrical case, the press button-type playback button turns on and a voice stored in a memory element is played back and necessary information is recorded by a recording button installed at the lower section. In particular, the cylindrical case is formed so as to accommodate the lower part of the milk bottle heretofore in use.

DETAILED DESCRIPTION OF THE PREFERRED EMBODIMENT

Figure 1:
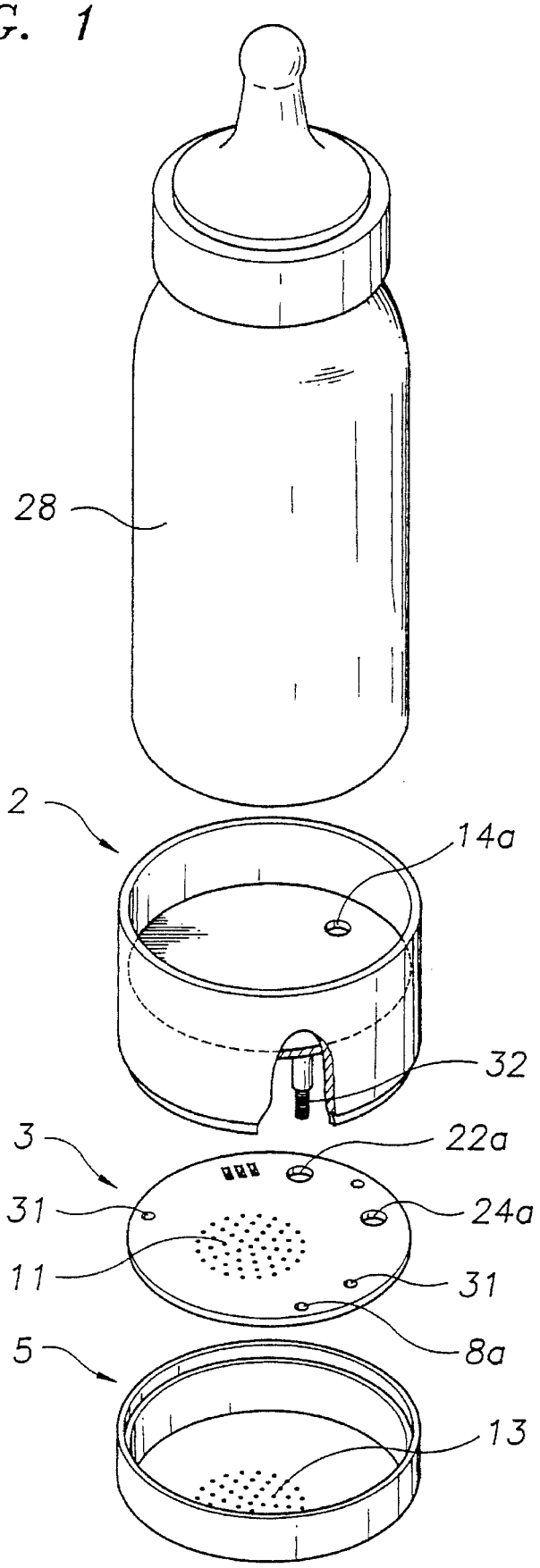
FIG. 1 is a disassembled perspective view of the present invention roughly illustrating each part thereof and a bottle
Figure 2:
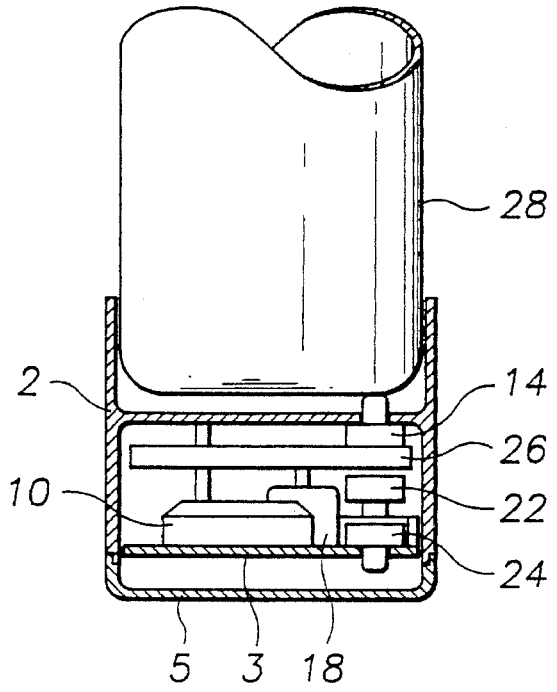
FIG. 2 is a cross-sectional view of the present invention illustrated in a condition where a milk bottle is united therewith

As shown in FIGS. 1 and 2, a memory-type recording/playback device according to the present invention comprises an upper case 2, an internal disk 3 and a lower case 5. This device is so framed as to install necessary parts between the upper case 2 and the internal disk 3 and fit a bottle 28 in the upside thereof. In other words, the device has a playback button 14, which is a press button-type switch, on the upper surface of the upper case 2 in which the bottle 28 is to be fitted and, when it stands straight, a printed circuit substrate 26, a speaker 10, a microphone 18 and an operation indication lamp 8 are located between the upper case 2 and the internal disk 3. A power switch 22 and a recording button 24 are also installed passing through the internal disk 3 and the lower case is fixed by being fitted in the outer lower side of the internal disk 3. Holes 8*a*, 14*a*, 22*a* and 24*a* illustrated in FIG. 1 are for mounting devices, such as an operation indication lamp 8, a playback button 14, a power switch 22, and a recording button 24, respectively. An electronic circuit for recording/playback is installed on the printed circuit substrate 26 between the upper case 2 and the internal disk 3. The playback button 14 is installed in the upper case 2 so as to project to the upside thereof. When the bottle 28 is fitted in the upper case 2, the playback button 14 is pressed and the electronic circuit is thereby operated. When this circuit operates, recorded voice or music is played back.

The printed circuit substrate 26 is built in between the upper case 2 and the internal disk 3. The internal disk 3 is fixed with nuts after three bolts formed on the upper case 2 are put into bolt holes 31. In the internal disk 3, holes 22*a*, 24*a* necessary to install the power switch 22 and the recording button 24 therein. Hole necessary to operate the microphone 18 and a speaker window 11 for playing back voices are provided.

The lower case 5 can be connected by closely attaching it to the upper case 2 or by screwing to thereto. A speaker window 13 is formed in the lower case 5. The power switch 22 and the recording button 24 are operated through opening the lower case 5. The power switch 22 is used to supply power to the whole circuit and the recording button 24 is used to store necessary sound. The microphone 18 is also used to store voice. The speaker 10 is used to play back the voice. The operation indication lamp 8 lets a user know the lapse of recording time.

Figure 3:
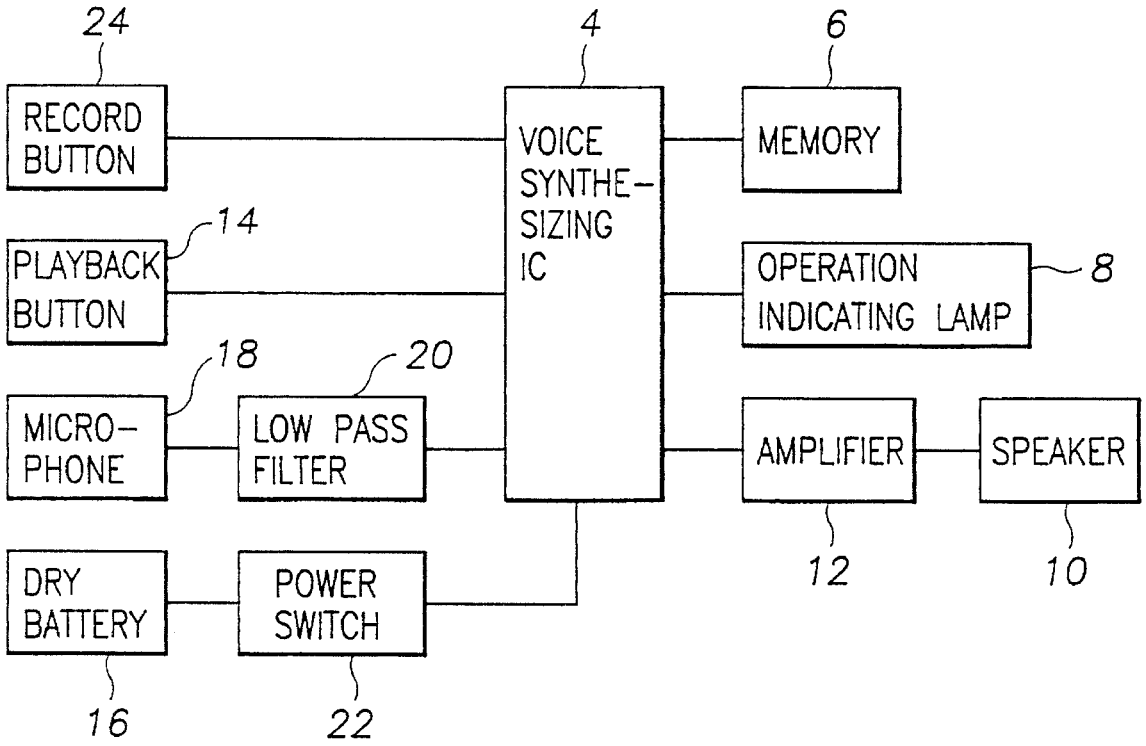
FIG. 3 is a roughly illustrated circuit block diagram of the present invention.

FIG. 3 is a roughly illustrated circuit block-diagram of the present invention. It comprises a recording button 24 which operates the circuit to record sound, a microphone 18 which records voice or music, a low-pass filter 20 which separates low-pass components from the audio signals of said microphone 18, a voice synthesizing integrated circuit 4 which converts the audio signals of said low-pass filter 20, a memory 6 which connects with said voice synthesizing integrated circuit 4 and stores audio signals, an operation indication lamp 8 which indicates the storing time of said memory element 6, a playback button 14 which plays back the audio signals stored in said memory element 6, an amplifier which amplifies the signals converted in said voice synthesizing integrated circuit 4 by the signals of said playback button 14, a speaker 10 which outputs the signals of said amplifier 12 as audible signals, a dry battery 16 which supplies power to the whole circuit, and a power switch 22.

In particular, the voice synthesizing integrated circuit 4, the memory element 6, the low-pass filter 20 and the amplifier 12 are installed on the printed circuit substrate 26 as illustrated in FIG. 2 and separated from other elements.

The voice synthesizing integrated circuit 4 is preferably an integrated circuit which records those signals inputted through the microphone 18 by converting the analog audio signals to digital signals when sound is recorded, and which converts the contents of the memory element 6 into synthesized analog audio signals which are played back. For example, Oki's MSM 6388 (Made in Japan) and Samsung's KS 5199 (Made in Korea) can be used as a suitable voice synthesizing integrated circuit.

In the case of Oki's MSM 6388, it transmits data between the memory element 6 and the voice synthesizing integrated circuit 4 by means of a serial port. The KS 5199, an integrated circuit manufactured by the Samsung Electronics Co., has a built-in DRAM refresh circuit, and so a general DRAM is usable as a memory element.

As the present recording/playback device uses neither a separate device nor a magnetic head, unlike a recorder which uses a cassette tape if prior art is used, the device can be miniaturized.

The working and effect of the present invention formed as mentioned hereinabove will now be described by referring to FIG. 2.

When a milk bottle 28 is fitted in the upper surface of an upper case 2, a playback button 14 is pressed and signals stored in a memory element 6 are converted in a voice synthesizing integrated circuit 4.

The converted signals are amplified through an amplifier 12 and then played back through a speaker 10. When the milk bottle 28 is separated from the playback button 14, the voice synthesizing operation is suspended. As the present invention keeps the playback button 14 pressed by the milk bottle 28 to let a baby hear recorded sound, it outputs the recorded sound repeatedly unless the bottle 28 is separated from the upper case 2.

To record mother's voice or other sound, remove a lower case 5 and press a recording button 24. When the hand is removed from the recording button 24, recording operation is finished. Audio signals inputted through a microphone 18 are converted to digitals signals in the voice synthesizing integrated circuit 4 after passing through a low-pass filter 20 and stored in the memory element 6. If recording time passes due mainly to the storing capacity of the memory element 6, an operation indication lamp 8 like an LED flickers and recording time is thereby adjustable. Accordingly, recording time can be lengthened to a necessary extent by increasing the memory element 6.

As the memory-type recording/playback device used by fitting a bottle therein uses the voice synthesizing integrated circuit and the memory element which are in wide use and lets a baby hear recorded mother's voice or music by playing it back repeatedly when the baby drinks from a bottle, it stabilizes the baby emotionally and produces the intended effect.

Although a detailed explanation is given only to the embodiment, it is apparent to those skilled in this field that alterations or modifications can be made within the spirit and scope of the present invention, but such alterations or modifications should be limited by the claims appended hereto.

What is claimed is:

1. A recording/playback device for use with a bottle comprising:

an upper case having an upper inner surface forming a recessed region in said casing for receiving and securing the lower side of the bottle within the recessed region;

an internal disk being adapted to fittedly unite with the lower portion of said upper case;

circuit means mounted within said casing between said internal disk and said upper case for selectively recording sound and playing back said recorded sound; and activating means for activating said circuit means to play back said recorded sound in response to said lower part of the bottle being received in said recessed region.

2. The device of claim 1, wherein the internal disk provides at least two openings and said device further comprises:

a record activator connected to said circuit means and accessible from the underside of the casing through one of said holes on the internal disk, said device being operated to record sound when said record activator is activated; and a power switch connected to said circuit means and accessible through said other opening for turning the device on and off.

3. The device of claim 2, further comprising:

a lower case being adapted to fittedly unite with the upper case so that the internal disk is located in between the lower and upper cases, said record activator and power switch being rendered inaccessible when said lower case is united with said upper case.

4. The device of claim 1, wherein said upper inner surface provides an opening and said activating means further comprises:

a play back activator operatively coupled to said circuit means to cause the recorded sound to be played back when said playback activator is activated, said play back activator being accessible through said opening such that the lower part of the bottle activates the play-back activator when received and secured within the recessed region.

5. A memory-type recording/playback device having a casing and being used by fitting a bottle in a receiving upper inner surface of the casing, comprising:

a printed circuit substrate having a voice synthesizing integrated circuit, a memory element which stores information indicative of signals provided by said voice synthesizing integrated circuit, a low-pass filter connected to said voice synthesizing integrated circuit, and a recording/playback circuit which includes an amplifier;

a playback button responsive to said fitting of said bottle for playing back recorded sounds installed on said receiving upper inner surface of said casing;

an internal disk which is united with said casing and on which a speaker connected to said amplifier, a recording microphone connected to said low pass filter, an operation indication lamp and a recording button connected to said voice synthesizing integrated circuit, and a power switch connected to a dry battery are installed; and wherein said casing comprises an upper case fittedly united with a lower case and wherein said lower case has a speaker window formed thereon.

6. The memory-type recording/playback device as defined in claim 5, in which said memory element is a DRAM.

7. The memory-type recording/playback device as defined in claim 5, in which said playback button is a press button-type switch and which is used by fitting the lower part of the bottle therein.

8. The memory-type recording/playback device as defined in claim 5, in which said operation indication lamp is an LED.

* * * * *